US006145164A

United States Patent [19]

Ferrari et al.

[11] Patent Number: 6,145,164

[45] Date of Patent: Nov. 14, 2000

[54] HINGE WITH A BASE TRANSVERSELY ADJUSTABLE BY MEANS OF A CAM

[75] Inventors: Franco Ferrari, Località Deviscio, 2, 23900 Lecco; Carlo Migli, Lecco, both of Italy

[73] Assignee: Franco Ferrari

[21] Appl. No.: 09/276,395

[22] Filed: Mar. 25, 1999

[30] Foreign Application Priority Data

Mar. 31, 1998 [IT] Italy ..... MI98U0225

[51] Int. Cl.[7] ..... E05D 7/04

[52] U.S. Cl. ..... 16/242; 16/235

[58] Field of Search ..... 16/242, 235–238, 16/257–259, 267, 382

[56] References Cited

U.S. PATENT DOCUMENTS

| | | | |
|---|---|---|---|
| 5,737,804 | 4/1998 | Ferrari et al. | 16/242 |
| 5,781,966 | 7/1998 | Ferrari et al. | 16/242 |
| 5,930,866 | 8/1999 | Rupprechter | 16/242 |
| 5,964,010 | 10/1999 | Huber | 16/242 |
| 6,032,333 | 3/2000 | Brustle | 16/242 |

*Primary Examiner*—Chuck Y. Mah

*Attorney, Agent, or Firm*—Shlesinger, Fitzsimmons & Shlesinger

[57] ABSTRACT

A hinge for furniture having a base (10) comprising a first element (41) which at the upper part thereof has coupling surfaces for a hinge wing and at the lower part thereof has a groove (20) receiving a second element (30) intended for being fastened to a piece of furniture. The first and second elements are mutually slidable in a direction transverse to the hinge extension by means of a rotary cam (27). The second element (30) is received in the groove in a drawer-like slidable manner in said transverse direction and the first element (41) comprises a through hole (25) disposed between the groove and the upper part. The cam (27) has a pivot pin (28) for rotation control which is fitted in said through hole (25) to be rotated therethrough, and the second element (30) has a face thereof turned towards the groove from which teeth (33, 35) forming reaction surfaces for the cam project, which teeth are disposed on opposite sides of the cam in the transverse direction. Possibly, a small block (38) may constitute an extension for operation of the cam pivot pin.

11 Claims, 3 Drawing Sheets

HINGE WITH A BASE TRANSVERSELY ADJUSTABLE BY MEANS OF A CAM

BACKGROUND OF THE INVENTION

The present invention relates to an improved hinge having a base provided with a cam-operated vertical-adjustment movement. Vertical-adjustment systems for bases of furniture hinges have been known for a long time. In their most general form bases making such an adjustment system possible, are made up of two components sliding on each other. The first component is intended for being rigidly fastened to a side of the piece of furniture and the second one for being connected to the hinge.

For adjustment of the mutual position of the two elements, the most traditional system contemplates use of a screw screwed down in one of the two elements and the head of which engages in an oval hollow formed in the other element. By unloosening the screw, vertical adjustment of the hinge is enabled. The main disadvantage is that when the screw is unloosened, the two elements are completely free to move with respect to each other. Thus an accurate adjustment is rather difficult.

Replacement of the adjustment screw with an eccentric rivet locking the two pieces in a direction perpendicular to the adjustment axis has been proposed. Vertical translation is obtained by the eccentric rotation, so that a continuous adjustment proportional to the rotation angle of the rivet is advantageously ensured. The rivet however has a drawback in that it is bulky in an axial direction (it must have at least three distinct sections: a head, an eccentric body and a region to be riveted) and has reduced sizes in a radial direction. Due to the small radial size, the maximum adjustment to be obtained by the base is reduced.

In the accomplishment of hinge adjustments, a strong structure is required which must be, at the same time, simple, of low cost and quick and efficient assembling. Accomplishment of an adjustment transverse to the hinge extension (i.e. a vertical adjustment when the hinge is mounted in place) is particularly problematic because the weight of the whole door rests thereon.

It is a general aim of the present invention to obviate the above mentioned drawbacks, by providing a hinge with an efficient, strong and simple cam adjustment of the vertical position.

SUMMARY OF THE INVENTION

In view of the above aim, in accordance with the invention, a hinge for furniture has been devised which has a base having surfaces for coupling with a wing of the hinge, the base comprising a first element having said coupling surfaces at the upper part thereof and a groove at the lower part thereof, for receiving a second element intended for being fastened to the piece of furniture, the first and second elements being mutually slidable in a direction transverse to the hinge extension by means of a rotary cam to give the hinge a transverse position adjustment, characterised in that the second element is received in the groove in a drawer-like slidable manner in said transverse direction, the first element comprising a through hole disposed between the groove and the upper part, the cam having a pivot pin for rotation control which is fitted in said through hole to be rotated therethrough, and the second element having a face turned towards the groove from which teeth forming reaction surfaces for the cam project, which teeth are disposed on opposite sides of the cam in said transverse direction.

BRIEF DESCRIPTION OF THE DRAWINGS

For better explaining the innovative principles of the present invention and the advantages it offers over the known art, a possible embodiment thereof applying said principles will be given hereinafter, by way of non-limiting example, with the aid of the accompanying drawings. In the drawings.

DETAILED DESCRIPTION OF THE INVENTION

Figure 1:
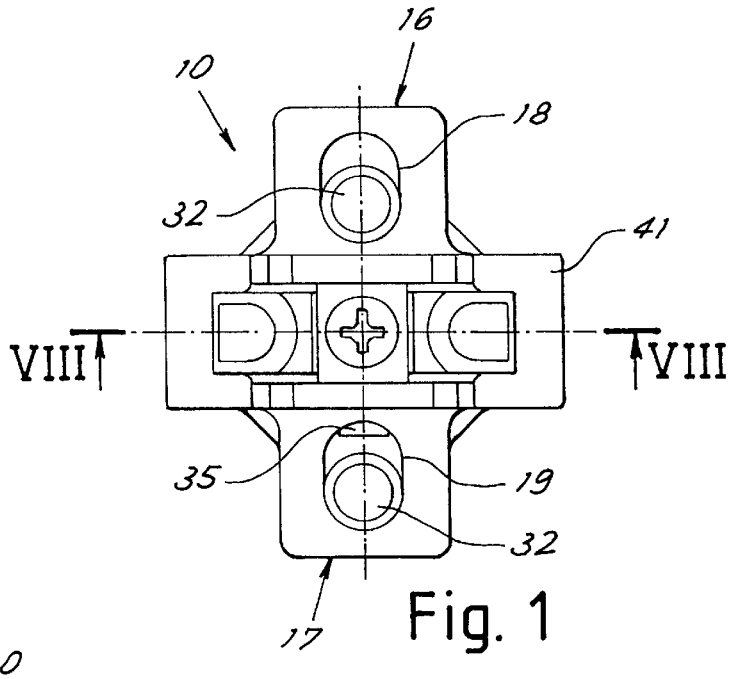
FIG. 1 is an upper plan view of a base in accordance with the invention.
Figure 9:
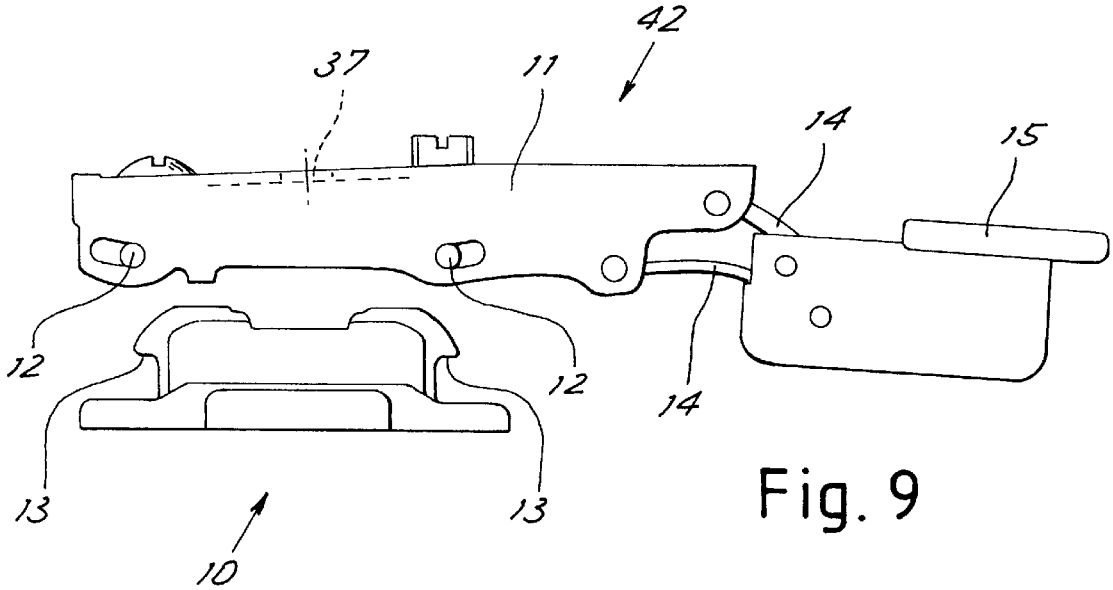
FIG. 9 is a diagrammatic view of a hinge assembly.

With reference to the drawings, shown in FIG. 1 is a base section (generally identified by 10) of a hinge for furniture 42. As shown in FIG. 9, the base is intended for fitting in the wing elogate wing section 11 of the hinge. For example, the wing section may comprise elastic means 12 for snap-fitting under projections 13 formed in the base. The wing section 11 is connected through articulated joints 14 to a fastening bowl 15 on the furniture door.

Figure 2:
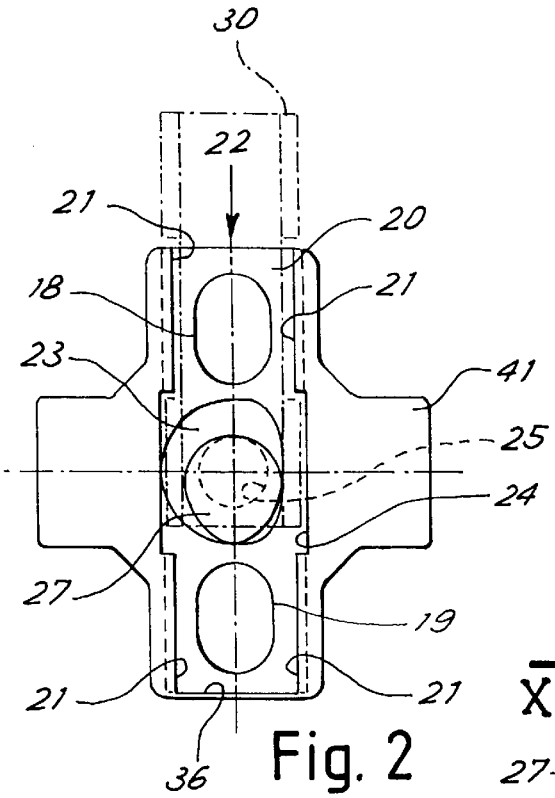
FIG. 2 is a lower plan view of a portion of the base shown in FIG. 1.

As can be viewed from FIG. 1, base 10 has thereon side projections 16, 17 having slots 18, 19 for passage of fastening screws. The slots are elongated transversely of the hinge extension to enable a vertical adjustment thereof. As shown in FIG. 2, base 10 is formed of a first element 41 having a groove 20 at the lower part thereof, in which slots 19 are located, and which groove is extended in a transverse direction and has side undercuts 21. Groove 20 has at least one open end 22. The opposite end 36 can be closed. Advantageously, the groove has a central portion 24 devoid of undercuts.

A hollow 23 communicating with the opposite face of the base through a hole 25 is present at the bottom of groove 20. A cam or eccentric 27 projecting from groove 20 is received in hollow 23.

Figure 3:
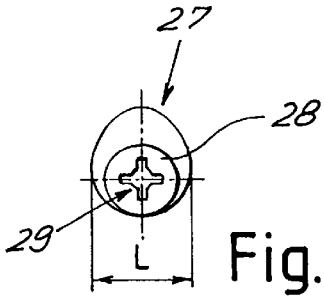
FIG. 3 is a front view of an adjustment cam.

Shown in FIG. 3 is said cam seen from the opposite side relative to that shown in FIG. 2. As can be seen, the cam has a cylindrical pivot pin 28 of a diameter adapted to be received with a minimum clearance into hole 25 in the base. The cylindrical pin 28 has an operation cut 29 on its head, which cut appears in hole 25 as shown in FIG. 1, to be operable by means of a screwdriver from the upper face of the base. Hollow 23 can be such shaped that it constitutes a restriction to maximum rotation of the cam. The cam has an eccentric section of constant diameter "L". An insert or second element 30 is received in a drawer-like slidable manner in groove 20 and it has wings or side runners 31 engaging in the undercuts 21. Runners 31 have a length substantially corresponding to that of the undercuts in the groove. In particular, advantageously, at least one pair of runners on both sides of the insert have a length not exceeding the central region 24 of the groove. The reason for that will be explained in the following.

Figure 8:
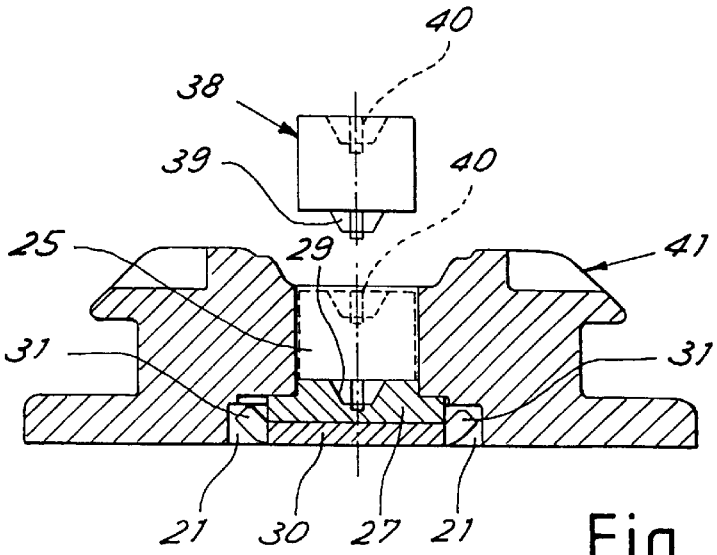
FIG. 8 is a section view taken along line VIII—VIII in FIG. 1.

The two runners can be obtained by bending of the insert edges in a V-shaped configuration towards the inside of the groove, whereas the undercuts can have a surface correspondingly inclined towards the groove bottom, as shown in FIG. 8.

Figure 5:
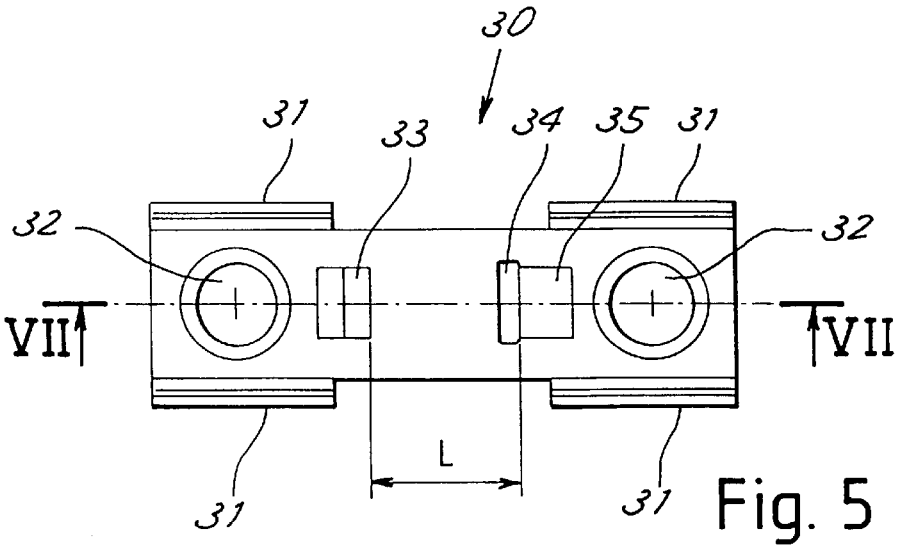
FIG. 5 is a plan view of a slidable element of the base.
Figure 6:
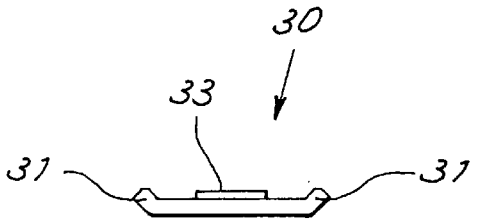
FIG. 6 is an end view of the element in FIG. 5.
Figure 7:
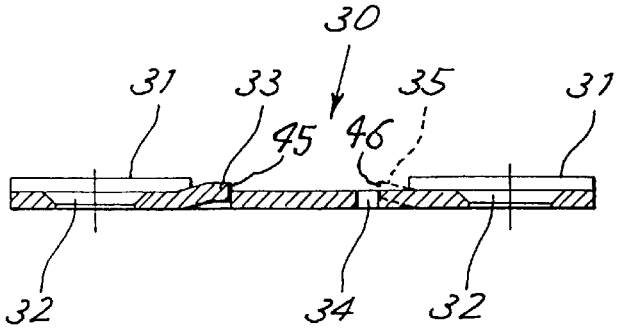
FIG. 7 is a section view taken along line VII—VII in FIG. 5.

As better viewed from FIGS. 5–7, insert 30, that can be advantageously formed by cutting out and bending of a metal plate, comprises, close to its ends, countersunk fastening holes 32 of a pitch equal to that of slots 18 and 19 in the base. In this way, screws (not shown) for fastening to the piece of furniture can be inserted into holes 32 through the slots, as seen in FIG. 1.

In a first embodiment, formed in the insert 30 by cutting out is a tooth 33 projecting from the upper surface of the plate. A notch 34 is formed at an opposite position relative to the centre line of the insert and it delimits a tab 35 of a laterally half-cut-out material, so that tab 35 can be easily bent and take a projecting shape similar to that of tooth 33.

Tooth 33 and tab 35 have respective facing edges 45, 46 that are at a distance "L" of a value almost equal to size "L" of the eccentric 27.

Assembling of the adjustable base begins with positioning of the eccentric, suitably oriented, in hollow 23, so that the cylindrical pin 28 enters hole 25. Subsequently, plate 30 is laid down on the base (as shown in chain dot line in FIG. 2) so that one pair of side projections 31 reaches a position at the central region devoid of undercuts of groove 20. The plate is disposed with tooth 33 turned towards the inside of the groove and close to its entry 22

Figure 4:
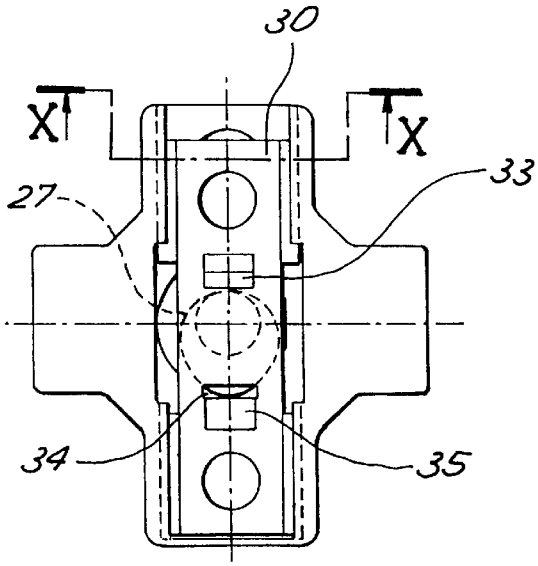
FIG. 4 is a lower plan view of the base in FIG. 1.

The plate is then caused to slide towards the final position of FIG. 4, so that both pairs of projections 31 are received under the undercut corresponding to the sides of groove 20. Depth of hollow 23 and thickness of the eccentric are sized in such a manner that the pairs of sliding projections 31 of the plate match in a precise manner or with a minimum of interference with the undercut walls 21.

The plate slides in the base body until tooth 33 abuts against cam 27 projecting from hollow 23. At this point, the 35 is bent towards the groove bottom (as shown in chain line in FIG. 7) and it takes a shape similar to that of tooth 33. The edges of tooth 33 and tab 35 spaced apart a distance "L" from each other are thus disposed on opposite sides of the cam, thereby locking the plate relative to the cam as viewed from FIG. 4.

For bending, the cam can be advantageously rotated in such a manner that the plate 30 comes to the position of maximum adjustment (FIG. 4), so that at least the base of tab 35 projects into the groove 19, as shown in FIG. 1. In this way a counter-punch can be fitted through groove 19 to carry out bending of the tab in an optimal manner.

Figure 10:
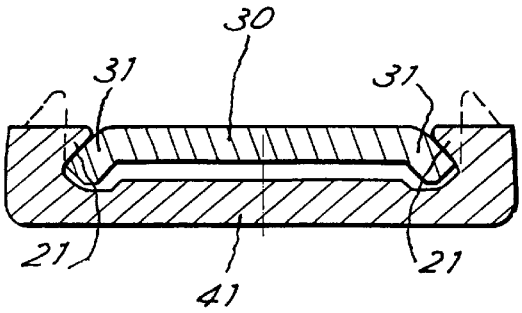
FIG. 10 is a section view taken along line X—X in FIG. 4.

According to a further embodiment, the undercut edges 21 are raised or open (as shown by broken line in FIG. 2), so as the plate 30 can be laid down into the cavity 20, instead of being caused to slide from an end. Once the plate lies in the cavity, the side walls of element 41 are deformed to the inside in order to form the undercuts 21 (as shown by continuous line in FIG. 10). Thanks to this embodiment, the edges 45, 46 forming side resting surfaces for the cam on the plate 30 can be made before assembling. Therefore, tab 35 can replaced by a tooth like the tooth 33. The plate 30 can also be made by casting, the edges 45, 46 being formed on its surface.

Assembling is thus completed and the base is ready to be mounted in a piece of furniture and coupled with wing 11 of remaining part of the hinge.

Vertical adjustment can be carried out by inserting a screwdriver in hole 25 for engaging the cam head and rotating it to the desired position. If an adjustment is wished when the wing 11 is fitted on the base, the wing 11 will have a passage 37 in register with hole 25 in the base.

In order to facilitate adjustment and improve access of the screwdriver, a small block or cylindrical insert 38 (shown in FIG. 8: in solid line in an exploded view and in chain line in place) can be inserted in passage 25; said insert 38 carries, at its lower end, the shaped portion 39 entering seat 29 in the cam by pressure and, at the other end, a seat 40 for the screwdriver.

By using a conveniently sized small block 38, the screwdriver can be always introduced to the same depth independently of the base height. In addition, the small block can be made of coloured plastic material to make access of the vertical adjustment of the base more apparent.

At this point it is clear that the intended purposes have been achieved, by supplying a hinge having a transversely-adjustable base, which is of easy and cheap construction, strong and efficient.

Obviously, the above description of an embodiment applying the innovative principles of the present invention is for purposes of illustration only and therefore must not be considered as a limitation of the scope of the invention as herein claimed.

For example, the shape and type of fitting between the hinge base and wing can vary depending on practical requirements, and also different can be the type of articulation of the hinge.

In addition, the second element 30 may have fastening means that in addition to consisting of mere holes for screw passage, may also involve other types of fastening elements such as small blocks fitted therein or of one piece construction therewith.

What is claimed is:

1. A hinge for furniture provided with a base section having thereon surfaces for coupling the base section with an elongate wing section of the hinge, the base section comprising a first element which at the upper part thereof has said coupling surfaces and at the lower part thereof has a groove receiving a second element intended for being fastened to the piece of furniture, a rotary cam, the first and second elements being mutually slidable in a direction transverse to the length of the wing section, by means of said rotary cam, for giving the hinge a transverse-position adjustment, characterised in that the second element is received in the groove in a drawer-like slidable manner in said transverse direction, the first element comprising a through hole extending between the groove and said upper part, the cam having a control pivot pin for rotation control which is fitted in said through hole to be rotated therethrough, and the second element having a face thereof confronting the bottom of the groove and having projecting therefrom spaced teeth forming reaction surfaces for engagement by the cam, said teeth being disposed on diametrally opposite sides of the cam in said transverse direction.

2. A hinge as claimed in claim 1, characterised in that the groove has spaced side walls that extend in said transverse sliding direction and have therein recessed undercuts for sliding accommodation of corresponding portions of the side edges of the second element.

3. A hinge as claimed in claim 2, characterised in that said corresponding portions of the side edges form two pairs of wings for sliding in the undercuts, the two pairs of wings being disposed close to the opposite ends of the second element, the undercuts being present close to corresponding ends of the groove and, at an intermediate position between its ends, the groove having a portion devoid of undercuts, the portion devoid of undercuts having an extension not lower than the extension of said pair of wings, so as to enable insertion of the wing pair through the portion devoid of undercuts during coupling of the first and second elements.

4. A hinge as claimed in claim 3, characterised in that the second element can be made of a cut-out and bent plate, the wings being bent towards the inside of the groove in a V-shaped configuration, and in that the undercuts have a correspondingly inclined surface.

5. A hinge as claimed in claim 2, characterised in that the undercuts are formed by deformation of the side walls of the groove.

6. A hinge as claimed in claim 1, characterised in that the teeth are cut out and bent in the thickness of the second element.

7. A hinge as claimed in claim 6, characterised in that the second element has a rectangular opening or notch through its thickness the edge of which forms at least one of said tooth reaction surfaces which is on the front side in the drawer-like insertion direction of the second element in the first.

8. A hinge as claimed in claim 1, characterised in that the first element has therethrough slots that are extended in said transverse direction, and which register with holes present in the second element for fastening of the latter to the piece of furniture.

9. A hinge as claimed in claim 8, characterised in that at least in one position of the sliding run of the first and second elements, one portion of one of said two teeth appears through one of said slots to enable introduction of a tooth-deforming tool into the slot.

10. A hinge as claimed in claim 1, characterised in that the bottom of the groove has a hollow recess for partial reception of the cam, the hollow recess having a side surface restricting maximum rotation of the cam.

11. A hinge as claimed in claim 1, characterised in that a cylindrical insert is fitted in the through hole, which insert has, at an end towards the cam, a shaped portion for fitting in the control pivot pin of the cam and, at the opposite end, a seat intended for engagement by a screwdriver for rotation of the cam.

* * * * *